United States Patent [19]

Thielen

[11] 4,071,983

[45] Feb. 7, 1978

[54] GRIDDLE CLEANING PAD HOLDER

[75] Inventor: James E. Thielen, New Brighton, Minn.

[73] Assignee: Minnesota Mining and Manufacturing Company, St. Paul, Minn.

[21] Appl. No.: 761,250

[22] Filed: Jan. 21, 1977

[51] Int. Cl.[2] ..... A47L 13/34; A47L 13/46; B24D 15/00

[52] U.S. Cl. ..... 51/393; 15/209 D; 15/231

[58] Field of Search ..... 15/209 B, 209 D, 228, 15/231-233, 186; 34/89.1, 89.2, 95.1, 95.2, 95.4; 51/170, 171, 391-393

[56] References Cited

U.S. PATENT DOCUMENTS

| | | | |
|---|---|---|---|
| 299,716 | 6/1884 | Bailey | 34/89.1 |
| 739,704 | 9/1903 | Nelson | 34/95.4 |
| 1,544,368 | 6/1925 | Brennan | 15/235.4 |
| 1,816,232 | 7/1931 | Robison | 34/95.2 |
| 1,936,360 | 11/1933 | Kaufmann | 15/231 X |
| 2,629,890 | 3/1953 | Giovanna | 15/209 D |

FOREIGN PATENT DOCUMENTS

| | | | |
|---|---|---|---|
| 176,713 | 10/1906 | Germany | 15/233 |
| 88,892 | 4/1921 | Switzerland | 15/104 R |

*Primary Examiner*—Daniel Blum
*Attorney, Agent, or Firm*—Cruzan Alexander; Donald M. Sell; Richard Francis

[57] ABSTRACT

A griddle cleaning pad holder comprised of a handle fastened to a flat base plate which is fitted with opposed inwardly facing rigid hooks capable of accommodating and holding therein an abrasive griddle cleaning pad. The hooks are disposed generally above the plane of the plate toward the handle so they will not contact the griddle surface when the pad is used. The preferred pad holder has protuberances covering the base plate surface to engage the pad surface in use.

3 Claims, 4 Drawing Figures

GRIDDLE CLEANING PAD HOLDER

BACKGROUND OF THE INVENTION

The present invention provides a novel griddle cleaning pad holder for holding abrasive griddle cleaning pads. Such pads are typically formed of filaments which are adhered together by a binder material which contains particulate abrasive material.

Commercial griddles are common to nearly every restaurant and in almost continuous use in so-call "fast food" restaurants. Such use causes residues to build-up and bake-on the griddle surface, producing a troublesome carbonized crust. This crust interferes with cooking, causes subsequently cooked foods to stick and may interfere with taste. Therefore, after an extended period of use, the griddle surface must be cleaned of residues. The usual way to clean a griddle surface is to abrade its surface while it is hot with an abrasive article such as a block or pumice or glass foam. Such products are fairly thick so that they are not difficult to hold with the hand.

Abrasive pads formed of filaments bonded together with a binder containing abrasive particles are also useful for cleaning griddle surfaces. Such pads, however, are somewhat difficult to hold by hand because they are generally made relatively thin. A holder therefore must be used or else the griddle surface must be permitted to cool before cleaning. Heretofore, such holders have been very complex and expensive or of the type which does not provide for mechanical engagement of the pad and the holder. In the latter type, the holder merely temporarily frictionally engages the pad by resting the holder on it pushing down on the pad while moving it about the griddle surface. Such an arrangement does not permit easy removal of the pad from the griddle surface and requires handling of the hot soiled pad.

BRIEF SUMMARY OF THE INVENTION

The present invention provides a griddle cleaning pad holder which has a simple non-complex structure with no moving parts, yet which provides for firm engagement of the griddle cleaning pad. The griddle cleaning pad holder of the invention comprises a handle fastened to a flat base plate which has opposed inwardly facing rigid hooks. The hooks are capable of accommodating and holding therebetween an abrasive griddle cleaning pad. The hooks are disposed generally above the plane of the plate toward the handle so that they will not contact the griddle surface when the pad is used. The preferred pad holder has protuberances covering the base plate surface creating a frictional engagement with the pad surface.

DRAWING

The griddle cleaning pad holder of the invention may be further understood by reference to the drawing, wherein the various figures, the same reference numeral refers to the same element;

DETAILED DESCRIPTION OF THE PRESENTLY PREFERRED EMBODIMENTS

Figure 1:
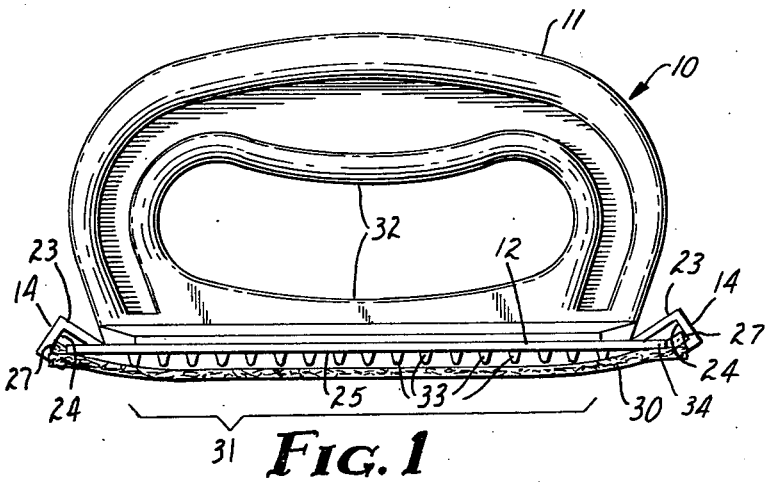
FIG. 1 shows a side elevational view of the griddle cleaning pad holder of the invention with a griddle cleaning pad held therein.
Figure 2:
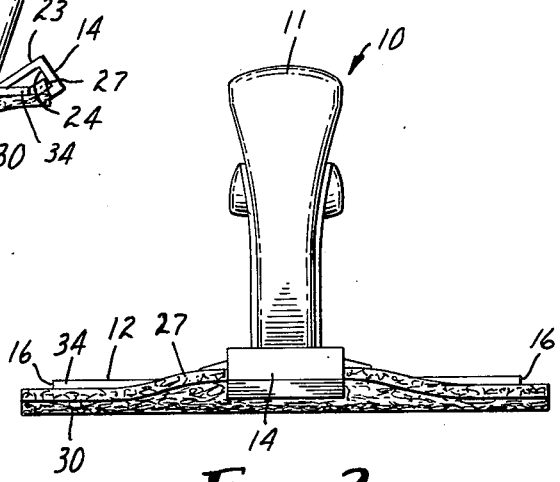
FIG. 2 shows an end elevational view of the griddle cleaning pad holder shown in FIG. 1.
Figure 3:
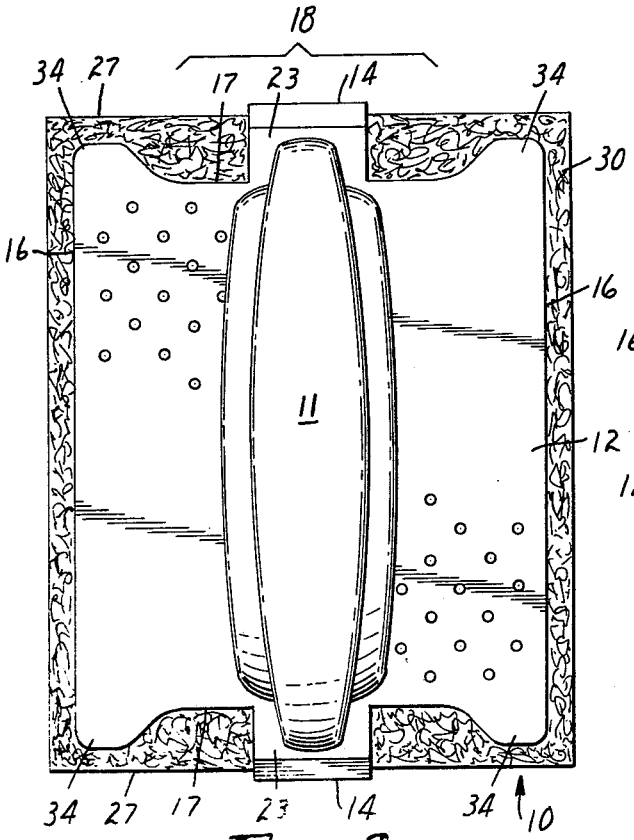
FIG. 3 shows a top plan view of the griddle cleaning pad holder shown in FIG. 1.
Figure 4:
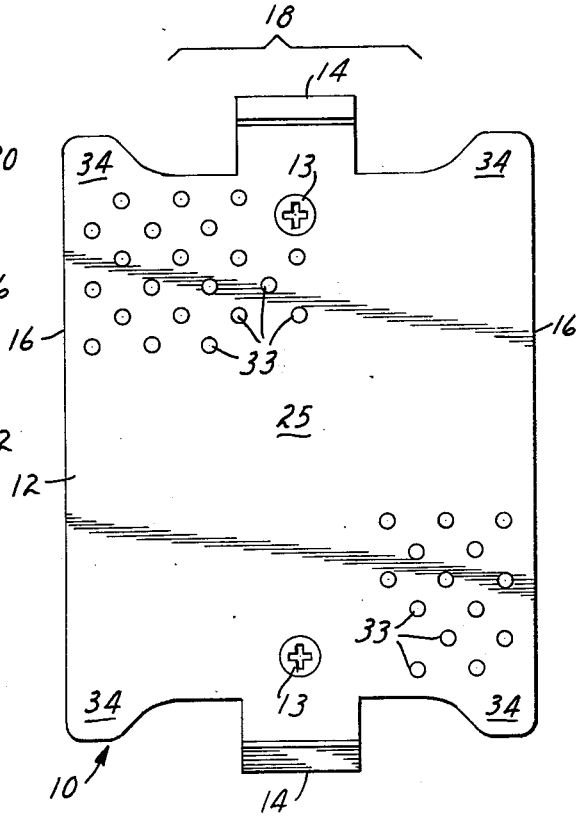
FIG. 4 shows a bottom plan view of the griddle cleaning pad holder of the invention with the griddle cleaning pad removed.

Referring now to the drawing, there is shown a griddle cleaning pad holder 10 comprised of handle member 11 which is secured to the upper face of flat base plate 12 by suitable fastening means, e.g., screws 13. Rigid hooks 14 are secured to and projecting from opposite ends of base plate 12. These hooks may be an integral part of the base plate or may be separate parts fastened to the plate by suitable fastening means. The shank portion 23 of the hooks project above the plane of plate 12 toward the handle at an angle between about 20° and 60°, depending upon the configuration of the mouth portion 24 of the hooks 14 such that no part of the hooks 14 contact the griddle surface when a pad mounted in the holder is used for cleaning. Hook mouth portions 24 face generally inwardly and toward the lower face 25 of the plate 12 and are dimensioned to receive and hold opposed edges 27 of a griddle cleaning pad 30. For this purpose, the griddle cleaning pad 30 will be of a size adapted to be accommodated with its opposed edges 27 within the hook mouths 24 and with the intermediate pad portion 31 disposed against the lower face 25 of the base plate 12.

The preferred handle member 11 has an arch-like shape as shown with a central opening 32 and is contoured to conform to the hand of the user. The handle member may be of any of a variety of other shapes which are known for this type or similar types of articles, the selection of the particular shape being within the skill of the art. The handle is preferably composed of a material which is somewhat rigid and, at least to a minor degree, heat resistant. That is, it should not melt or burn when exposed to temperatures which are typically encountered in the vicinity of the surface of a griddle. The handle may be formed of metal but is preferably formed of a plastic material such as nylon or a phenolic resin.

The preferred griddle cleaning pad holder of the invention has a plurality of closely spaced protuberances 33 covering the lower space of plate 12 to provide better frictional engagement with the griddle cleaning pad while it is being used on the griddle surface.

The preferred griddle cleaning pad holder of the invention has a plate 12 which has parallel sides 16 and parallel edges 17 with the hooks being attached or projecting from an intermediate portion 18 of the ends. Most preferably, the ends of the sides 16 project beyond the line defining the extension of the edges 17 to the sides to provide projecting tab portions 34 having outer edges defined by the extensions of sides 16, creating a recess therebetween to facilitate the engagement of a stiffer griddle cleaning pad and to provide a supporting surface at the corners of a rectangular cleaning pad.

What is claimed is:

1. A griddle cleaning pad holder for hand use for holding a stiff but resilient griddle cleaning pad, comprising, in combination:

an elongated flat base plate having an upper face, a lower face, parallel sides, opposite intermediate end portions, and end tab portions on either side of said intermediate end portions projecting from the line defining the extension of said intermediate end portions to said sides and having outer edges defined by the extension of said parallel sides;

a handle member secured to the upper face of said base plate; and a pair of rigid hooks, each of said hooks having a mouth and a shank, one of said shanks being secured to and projecting from each of said opposite intermediate end portions of said base plate, the shanks of said hooks projecting above the plane of said plate toward said handle at an angle between about 20° and 60° with respect to said plate, the mouths of said hooks facing generally inwardly and toward said lower face and being dimensioned to receive and hold opposed edges of a griddle cleaning pad of a size adapted to be accomodated with said opposed edges within said mouths and with intermediate portion of said pad disposed against the lower face of said base plate, and such that, when the exposed face of an engaged pad contacts a griddle surface for use, no part of said hooks contact said griddle surface.

2. The pad holder of claim 1 wherein the lower face of said flat base plate is covered with a plurality of closely spaced protuberances.

3. The pad holder of claim 1 further including a griddle cleaning pad.

* * * * *